United States Patent [19]

Scarry

[11] Patent Number: 4,653,753

[45] Date of Patent: Mar. 31, 1987

[54] HOCKEY STICK TRAINING DEVICE

[76] Inventor: Brian Scarry, #17, 125 Park Dr., Boston, Mass. 02115

[21] Appl. No.: 756,502

[22] Filed: Jul. 19, 1985

[51] Int. Cl.[4] ..... A63B 59/14

[52] U.S. Cl. ..... 273/67 A; 273/1 B

[58] Field of Search ..... 273/1 B, 67 A, 67 D, 273/67 DA, 67 DB, 67 DC, 194 A; D21/210, 211, 214; 434/247

[56] References Cited

U.S. PATENT DOCUMENTS 3,353,826 11/1967 Traverse ..... 273/67 A 3,595,582 7/1971 Chapman ..... 273/194 A 3,834,697 9/1974 McNamara, Jr. et al. ..... 273/1 B 3,844,555 10/1974 Tremblay ..... 273/67 A

*Primary Examiner*—Richard C. Pinkham

*Assistant Examiner*—Matthew L. Schneider

[57] ABSTRACT

A training device for hockey players comprising a hockey stick comprising a shaft having a handle at a first end and a blade at a second end. A device for obscuring the vision of the user is attached to the shaft at a position intermediate the blade and the handle and spaced from the blade. The device consists of a planar member that overlies the blade of the stick.

7 Claims, 3 Drawing Figures

HOCKEY STICK TRAINING DEVICE

FIELD OF THE INVENTION

The present invention relates to the sport of ice hockey and other similar less formal variations thereof and in particular to a training aid attachment to a hockey stick.

BACKGROUND OF THE INVENTION

The proficient hockey player must possess coordination, timing and rhythm with respect to puck handling, passing and shooting. Such skills are developed by extensive practice both alone and during group practice. Probably the most important skill to be developed is that of puck handling. However, during solitary practice there is a tendency to watch the blade of the hockey stick to ensure the puck is properly carried by it. During group practice such a tendency to watch the blade could result in poor play from the result of collisions, failure to recognize passing opportunities and the like.

SUMMARY OF THE INVENTION

The present invention is directed to a training device for a hockey stock adapted to obscure the player's view of the blade of the hockey stick and a puck associated with the blade.

The invention accordingly comprises a hockey stick having line of vision obscuring means located on the hockey stick intermediate the handle and the blade.

DETAILED DESCRIPTION OF THE INVENTION

Figure 1:
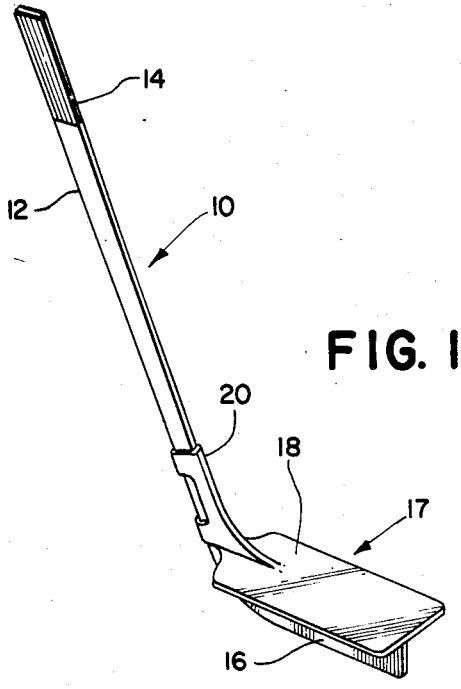
FIG. 1 is a perspective view of a hockey stick having the line of vision obscuring element mounted thereon.

The purpose of the training device of the present invention is to develop in the player the ability to keep his head up and enhance his mobility while skating with or passing or shooting the puck. If the player cannot see the puck as it is carried by the blade, there is no incentive to indulge in the novice's fault of keeping his eye on the puck instead of his surroundings. Accordingly, the player's overall game skills, especially his puck handling ability and feel for the puck is developed as well as developing and enhancing periferal vision.

The object of this invention is achieved by locating on the shaft of the hockey stick intermediate the handle and the blade means to obscure the player's view of the blade as the player grasps the hockey stick in the conventional manner. Preferably, the view obscuring means comprise a substantially planar, opaque or translucent element located on the shaft above the blade.

The size and shape of the line of vision obscuring means are not critical so long as it is of sufficient size and shape to obscure the player's view of the blade and a puck carried thereby. Preferably, the line of vision obscuring means comprise a substantially rectangular member mounted on the shaft slightly above, and generally parallel to, the blade.

The vision obscuring member or element may be composed by any suitable material such as plastic, wood or metal. Preferably, light-weight plastic material is employed so as not to disturb the balance of the stick or add excessive weight. While the member is preferably composed of a relatively durable material to be able to withstand damage occurring during practice, if weight and cost constitute a significant factor, the member may be composed of a plastic foam material such as polystyrene. While opaque material is preferred, it is only necessary that the player's vision be adequately obscured so that he cannot see the blade or puck. Therefore, translucent material may also be employed.

As stated above, the line of vision obscuring means may be located anywhere on the shaft between the handle and the blade. Preferably, the line of vision obscuring means are located next adjacent the blade, sufficiently removed from the blade so as not to interfere with the puck-handling action. Generally, about 3 in. up the shaft from the blade is sufficient. In this embodiment, a member of relatively small dimensions can be employed to effectively block the player's view of the blade and puck, whereas, the closer to the handle, the larger the member would have to be to shield the blade from the player's line of vision.

Since during play, the hockey stick is located at various angles to the body of the player, some of these angles could afford a view around the horizontal element of the puck being carried by the blade. Accordingly, it is preferred that the width of the horizontally disposed line of vision obscuring means be about 6 to 9 inches which would provide sufficient cover for most viewing angles.

The line of vision obscuring means may be secured to the shaft by any suitable means, such as screws, glue, clamps and the like. The securing means may be permanent or temporary, i.e., the vision obscuring means may be removable.

Figure 2:
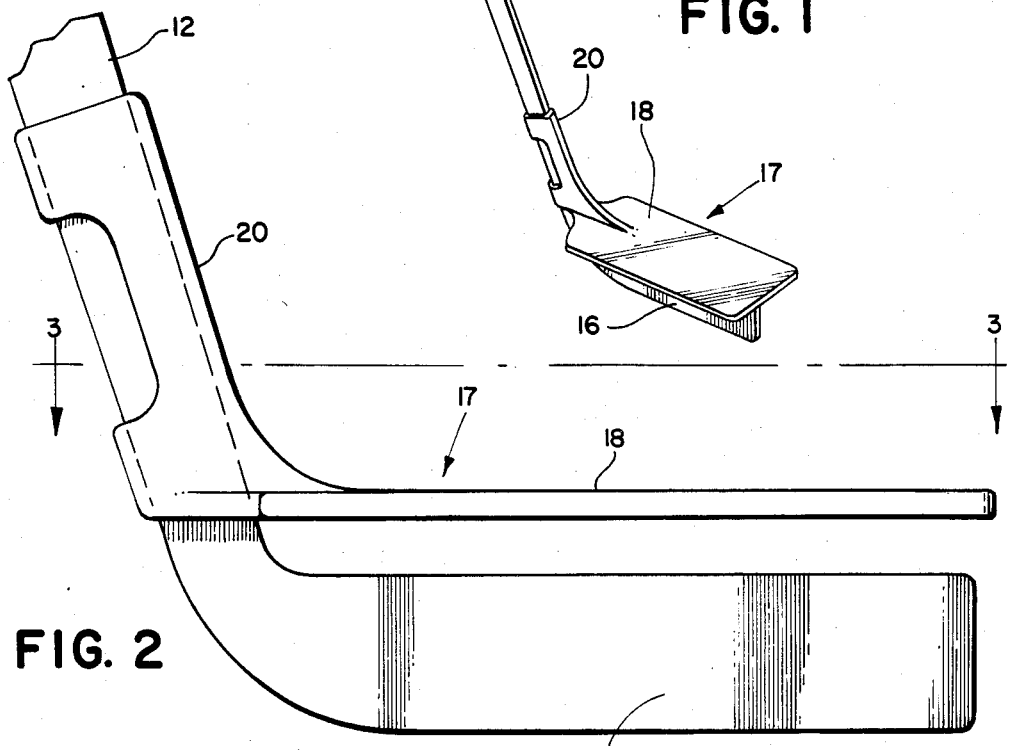
FIG. 2 is a side view of the bottom portion of the hockey stick of FIG. 1 showing a preferred embodiment of the present invention.

Turning now to the drawings, FIG. 1 is a perspective view of hockey stick 10 consisting of shaft 12 having handle 14 at one end and blade 16 at the other end. The line of vision or line of sight obscuring element 17 is mounted on shaft 12 intermediate handle 14 and blade 16 and is so positioned next adjacent blade 16 that a player gripping handle 14 would be unable to see blade 16 and an associated puck. The line of vision obscuring element is composed of substantially flat, rectangular horizontal element 18 parallel to blade 16 and of such a size as to shield the blade and a puck associated with the blade from the player's view. Horizontal element 18 is secured to the shaft, in this embodiment by snap-on connector 20. FIG. 2 is a side view showing a close up of the bottom portion of the hockey stick of FIG. 1 illustrating in more detail the relationship of the line of sight obscuring element 17 and blade 16.

Figure 3:
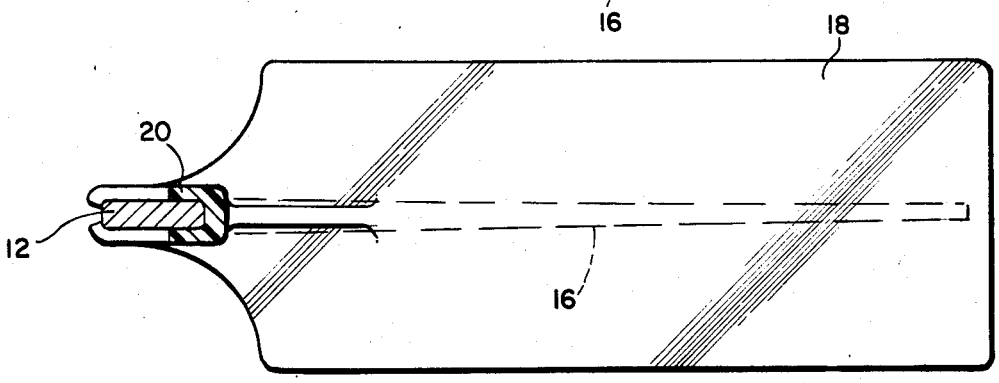
FIG. 3 is a top view of the hockey stick taken along line 3—3 of FIG. 2.

FIG. 3 is a view along lines 3—3 of FIG. 2 which shows the view the player has from the top of the stick 10 as he holds the stick by handle 14. It will be seen that horizontal element 18 obscures the view of blade 16 (shown in dotted lines). Thus, from the perspective of the player blade 6 and anything associated with it would not be visible.

What is claimed is:

1. A hockey stick comprising a shaft having a handle on a first end and a blade on a second end, vision obscuring means secured to said shaft intermediate said handle and said blade and spaced apart from said blade, said vision obscuring means overlying a substantial portion of said blade whereby the view of said blade from said handle is obscured.

2. The hockey stick of claim 1 wherein said vision obscuring means comprise a substantially planar horizontal member.

3. The hockey stick of claim 1 wherein said vision obscuring means is opaque.

4. The hockey stick of claim 1 wherein said vision obscuring means is translucent.

5. The hockey stick of claim 1 wherein said vision obscuring means is substantially rectangular.

6. The hockey stick of claim 1 wherein said vision obscuring means is releasably mounted on said shaft.

7. The hockey stick of claim 1 wherein said vision obscuring means is substantially perpendicular to the plane of the blade.

* * * * *